US007628475B2

(12) United States Patent
Langford et al.

(10) Patent No.: US 7,628,475 B2
(45) Date of Patent: Dec. 8, 2009

(54) PRINTHEAD EVACUATION MECHANISM AND METHOD

(75) Inventors: Jeffrey D Langford, Lebanon, OR (US); Ross E Friesen, Corvallis, OR (US); Carrie E. Harris, Corvallis, OR (US); Harold F Mantooth, Vancouver, WA (US); Donald L. Michael, Monmoth, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 11/927,097

(22) Filed: Oct. 29, 2007

(65) Prior Publication Data

US 2008/0043075 A1 Feb. 21, 2008

Related U.S. Application Data

(63) Continuation of application No. 11/040,601, filed on Jan. 21, 2005, now Pat. No. 7,296,881.

(51) Int. Cl.
*B41J 2/17* (2006.01)
*B41J 2/195* (2006.01)

(52) U.S. Cl. ..... 347/84; 347/7

(58) Field of Classification Search ..... 347/84, 347/87, 7, 89, 92, 86, 40, 85
See application file for complete search history.

(56) References Cited

U.S. PATENT DOCUMENTS

| | | | | |
|---|---|---|---|---|
| 4,223,324 | A | 9/1980 | Yamamori et al. | |
| 4,791,438 | A | 12/1988 | Hanson et al. | |
| 4,931,812 | A | 6/1990 | Dunn et al. | |
| 5,084,712 | A | 1/1992 | Hock et al. | |
| 5,182,581 | A | 1/1993 | Kashimura et al. | |
| 5,936,650 | A | 8/1999 | Ouchida et al. | |
| 5,956,062 | A * | 9/1999 | Omata et al. | 347/89 |
| 6,007,193 | A | 12/1999 | Kashimura et al. | |
| 6,116,727 | A | 9/2000 | Hagiwara | |
| 6,224,198 | B1 | 5/2001 | Cook et al. | |
| 6,224,201 | B1 | 5/2001 | Shigemura | |
| 6,231,174 | B1 * | 5/2001 | Haigo | 347/89 |
| 6,457,820 | B1 * | 10/2002 | Cai et al. | 347/92 |
| 6,773,097 | B2 | 8/2004 | Dowell | |
| 7,121,653 | B2 | 10/2006 | Lai | |
| 7,510,274 | B2 * | 3/2009 | Davis et al. | 347/92 |
| 2002/0118256 | A1 | 8/2002 | Dixon et al. | |
| 2005/0007427 | A1 | 1/2005 | Bellinger et al. | |
| 2005/0157009 | A1 | 7/2005 | Silverbrook et al. | |
| 2005/0157104 | A1 * | 7/2005 | Hirota et al. | 347/85 |
| 2006/0092243 | A1 * | 5/2006 | Langford et al. | 347/85 |

FOREIGN PATENT DOCUMENTS

| | | | |
|---|---|---|---|
| EP | 0 375 383 | B1 | 8/1993 |

* cited by examiner

*Primary Examiner*—Stephen D Meier
*Assistant Examiner*—Carlos A Martinez, Jr.

(57) ABSTRACT

In one embodiment, a printhead assembly includes: an ink reservoir; a printhead; a passage for carrying ink from the ink reservoir to the printhead; and a port from the passage to a source of air pressure. The port is operable between a closed position in which the passage is not pressurized with air and an open position in which the passage is exposed to pressurized air. In another embodiment, an ink supply includes: a reservoir for holding ink; a printhead; a standpipe connecting the reservoir and the printhead such that ink may flow from the reservoir to the printhead through the standpipe; and a valve operatively connected to the standpipe. The valve is operative between a first position in which the standpipe is pressurized with air and a second position in which of the standpipe is not pressurized with air.

17 Claims, 4 Drawing Sheets

PRINTHEAD EVACUATION MECHANISM AND METHOD

CROSS REFERENCE TO RELATED APPLICATIONS

This is a continuation of application Ser. No. 11/040,601 filed Jan. 21, 2005 now U.S. Pat. No. 7,296,881, titled Printhead Evacuation Mechanism And Method. Priority is claimed under 35 U.S.C. §120.

TECHNICAL FIELD

The present invention relates generally to methods and mechanisms for preventing failures in an inkjet print cartridge. More specifically, the present invention relates to a venting mechanism used to prepare inkjet print cartridges for periods of inactivity.

BACKGROUND

Inkjet print cartridges typically use inks that include a volatile solvent such as alcohol and/or water. Where inkjet print cartridges remain inactive for long periods, as when the print cartridge is in transit to an end user, is in storage, or where the printer in which the print cartridge is installed is not used for long periods, the solvents in the inks will begin to evaporate. This evaporation is especially problematic in the area of the nozzles of the print cartridge as the evaporating solvents leave behind solid deposits of pigments and the like that can occlude the nozzles, thereby rending the print cartridge inoperative and/or can reduce the print quality thereof.

Many steps have been taken to prevent the evaporation of ink solvents from a print cartridge, with the aim of preventing occlusions of the print cartridge nozzle. One solution has been to apply tape over the print cartridge nozzles. While this solution does reduce evaporation of solvents from the ink in the print cartridge, it does not prevent all such evaporation. Furthermore, the use of tape over the nozzles of the printhead is typically useful only prior to the installation of the print cartridge in a printer; a user cannot easily reapply tape over the nozzles of the print cartridge.

Another solution is to provide a pumping mechanism that can remove ink from the print cartridge, or at least from the region of the print cartridge adjacent the nozzles thereof; the idea being that where there is no ink, there can be no evaporation and the incidence of occlusions will decrease. However, such systems are complicated and in any case, it has been difficult to remove all ink from the region of the print cartridge adjacent to the nozzles thereof.

Accordingly, there is a need for a method and a mechanism that will facilitate the removal of ink from the region of a print cartridge adjacent to the nozzles thereof where the print cartridge will remain inactive for a time. In addition, there is a need for a mechanism that can prime a print cartridge in which ink has been removed from the region of the print cartridge adjacent the nozzles so that the print cartridge may begin or resume printing.

DETAILED DESCRIPTION

Figure 1:
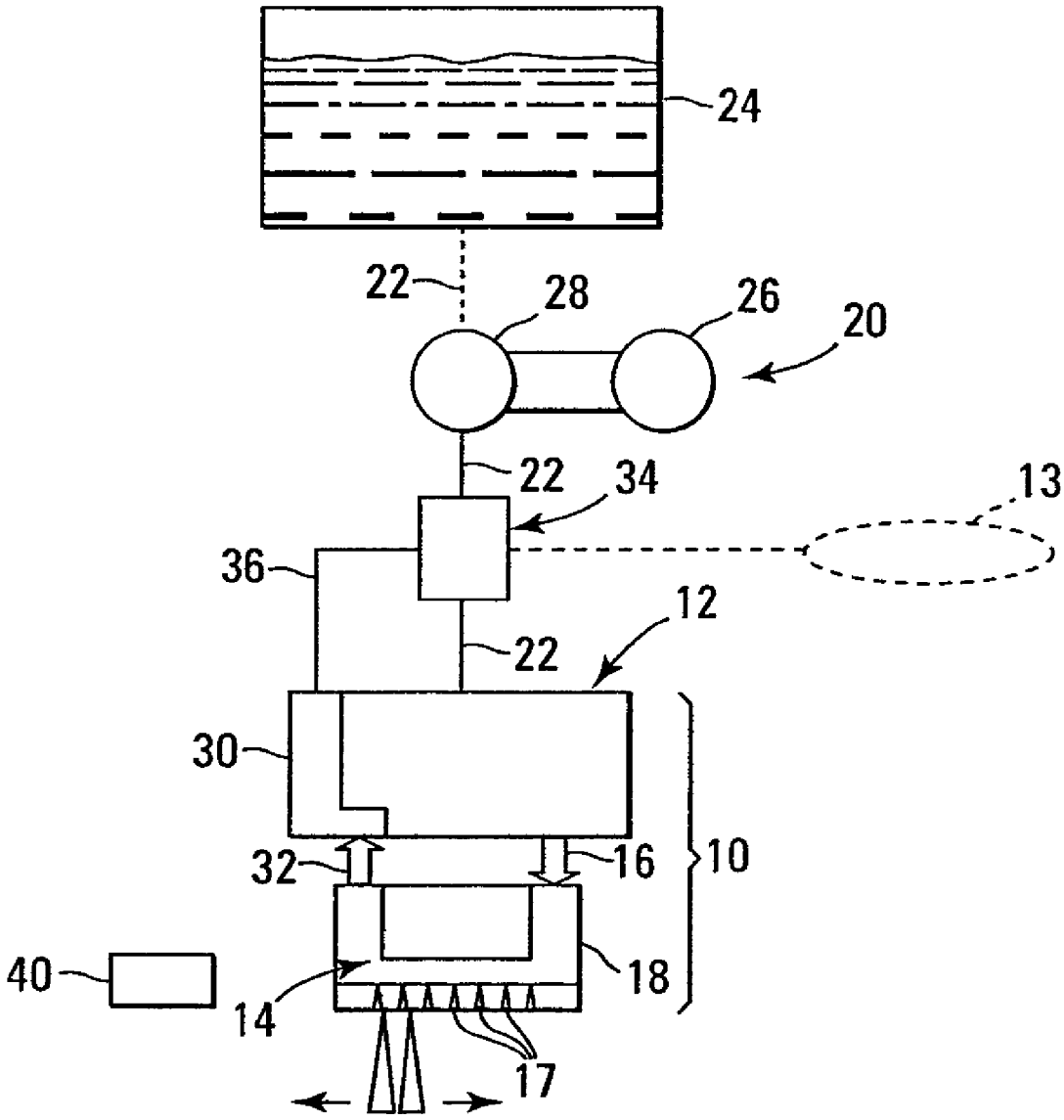
FIG. 1 is a schematic cross section view of a print cartridge that incorporates one embodiment of a venting mechanism and an embodiment of an ink supply system.

In the following detailed description of the invention, reference is made to the accompanying drawings that form a part hereof and in which is shown, by way of illustration, specific embodiments in which the invention may be practiced. In the drawings, like numerals describe substantially similar components throughout the several views. These embodiments are described in sufficient detail to enable those skilled in the art to practice the invention. Other embodiments may be utilized and structural, logical, and electrical changes may be made without departing from the scope of the present invention. The following detailed description is, therefore, not to be taken in a limiting sense, and the scope of the present invention is defined only by the appended claims and equivalents thereof.

FIG. 1 illustrates schematically one embodiment of a print cartridge 10. Print cartridge 10 has one or more reservoirs 12 that are fluidically coupled to a standpipe 14 by coupling 16. Standpipe 14 has a printhead 18 that is adapted for dispensing ink from the standpipe 14 in an inkjet printing process of a type known in the art. As ink is expelled from one or more nozzles 17 the printhead 18, a vacuum is generated in the standpipe 14 that acts to draw ink from reservoir 12 into the standpipe 14 through coupling 16. As used herein, the term vacuum pressure is used to designate a reduced pressure that is generally lower than a reference pressure, which in one embodiment is atmospheric pressure, and in another embodiment is a source of pressurized air or other fluids.

In one embodiment, coupling 16 is a passage or conduit having a check valve or filter installed therein for controlling the flow of ink from reservoir 12 to standpipe 14. That is, a vacuum within the standpipe 14 will act to draw ink through the coupling 16. However, absent a sufficiently large pressure differential, ink will not generally flow freely through the coupling 16 from the reservoir to the standpipe 14, though a nominal amount of ink may continue to flow. In one embodiment, the check valve will be selected such that the surface tension of ink and its solvents on the check valve will prevent the flow of ink therethrough where there is air or another similar fluid present on one side of the check valve, such as where all ink has been removed from the standpipe 14 and the standpipe 14 contains only air.

As ink is drawn from the reservoir 12 and into standpipe 14, a vacuum is generated within the reservoir 12. In one embodiment, the vacuum in reservoir 12 acts to draw additional ink from an auxiliary or supplemental reservoir 24 that is fluidically connected to the reservoir 12 by conduit 22. In another embodiment, a pumping mechanism 20 actively pumps ink from reservoir 24 into reservoir 12 to replenish the ink ejected by the printhead 18. Pumping mechanism 20 includes a motor 26 that is coupled to a pump 28. The pumping mechanism 20 may be manually actuated when the print cartridge 10 is determined to be out of ink or when it is determined that the level of ink in the reservoir 12 is below a predetermined minimum. Alternatively, the vacuum in the reservoir 12 may be sensed by a sensor (not shown) whose output actuates the pumping mechanism 20.

Where a print cartridge 10 is to remain unused for an extended period of time, the print cartridge 10 may be de-primed, i.e. ink may be removed from the standpipe 14 and the printhead 18 to prevent the clogging of the nozzles 17 of the printhead 18 and subsequent malfunctions of the print cartridge 10 that may arise therefrom. The print cartridge 10 is de-primed by coupling the standpipe 14 to pressures higher than those present in the reservoir 12. In one embodiment, a snorkel 30 is fluidically coupled to standpipe 14 by a conduit 32. Snorkel 30 is in turn fluidically coupled to a valve mechanism 34 by conduit 36. The valve mechanism 34 is adapted to selectively connect the snorkel 30 to atmospheric air, which is at a generally higher pressure than the vacuum within the reservoir 12 and standpipe 14. Alternatively, the valve mechanism 34 may connect the snorkel 30 to a source of high-pressure air 13.

As described above, the act of ejecting ink from the printhead 18 during printing generates a vacuum within the volume of the standpipe 14. This vacuum in turn draws ink from the reservoir 12 into the standpipe 14, thereby giving rise to a vacuum within the reservoir 12. Introducing to the standpipe 14 a higher pressure by coupling the snorkel 30 to the atmosphere or to a source of higher pressure creates a pressure differential that acts to force ink from the standpipe 14 through the conduit 16 and back into the reservoir 12. When the air or other gas introduced into the standpipe 14 contacts the check valve or filter, ink is substantially prevented from flowing into the standpipe 14 from the reservoir 12.

In one embodiment, a wiper 36 may be simultaneously employed to prevent clogging of the nozzles 17 of the printhead 18. Wiper 36 moves laterally with respect to the print cartridge 10 such that the tips 38 of the wiper 36 are drawn across the surface of the printhead 18. The wiping action of the tips 38 against the printhead 18 acts to remove excess liquid ink and/or accretions formed around or in the nozzles 17 of the printhead 18. In another embodiment, the wiper 36 may be provided with a wick 40 that dispenses a non-volatile material that, when applied to the printhead 18, prevents ink in the nozzles 17 from drying out and also prevents the ingress of air into the print cartridge 10 through the printhead 18. As wiper 36 moves laterally, the tips 38 of the wiper 36 are drawn across the wick 40 and a small amount of the non-volatile material is deposited thereon. The non-volatile material is then applied to the printhead 18 by the tips 38 of the wiper 36. In one embodiment, the non-volatile material remains relatively viscous and does not cure or harden to any significant degree. In this manner, re-priming of the print cartridge 10 is not impeded by accretions of the non-volatile material within the nozzles 17 of the printhead.

Re-priming of the print cartridge 10 in preparation for printing operations after a period of inactivity involves filling the standpipe 14 with ink. In one embodiment, the pumping mechanism 20 is activated to pump ink into the reservoir 12 under sufficient pressure to force ink through conduit 16 and into the standpipe 14. Alternatively, the valve mechanism 34 may be actuated to couple the supplemental reservoir 24 directly to the standpipe 14 such that the pumping mechanism 20 can pump ink directly into the standpipe 14 as through conduit 36. In another embodiment, the pumping mechanism 20 may be coupled to the snorkel 30. Thereafter, ink and/or air within the snorkel 30 and standpipe 14 is withdrawn by the pumping mechanism 20 to generate a vacuum therein, thereby drawing ink into the standpipe 14 from the reservoir 12 for printing.

In addition to priming and de-priming the print cartridge, the supplemental reservoir 24 and pumping mechanism 20, may also be used to supply ink to one or more print cartridges 10 to replenish the reservoir 12 during printing.

Figure 2:
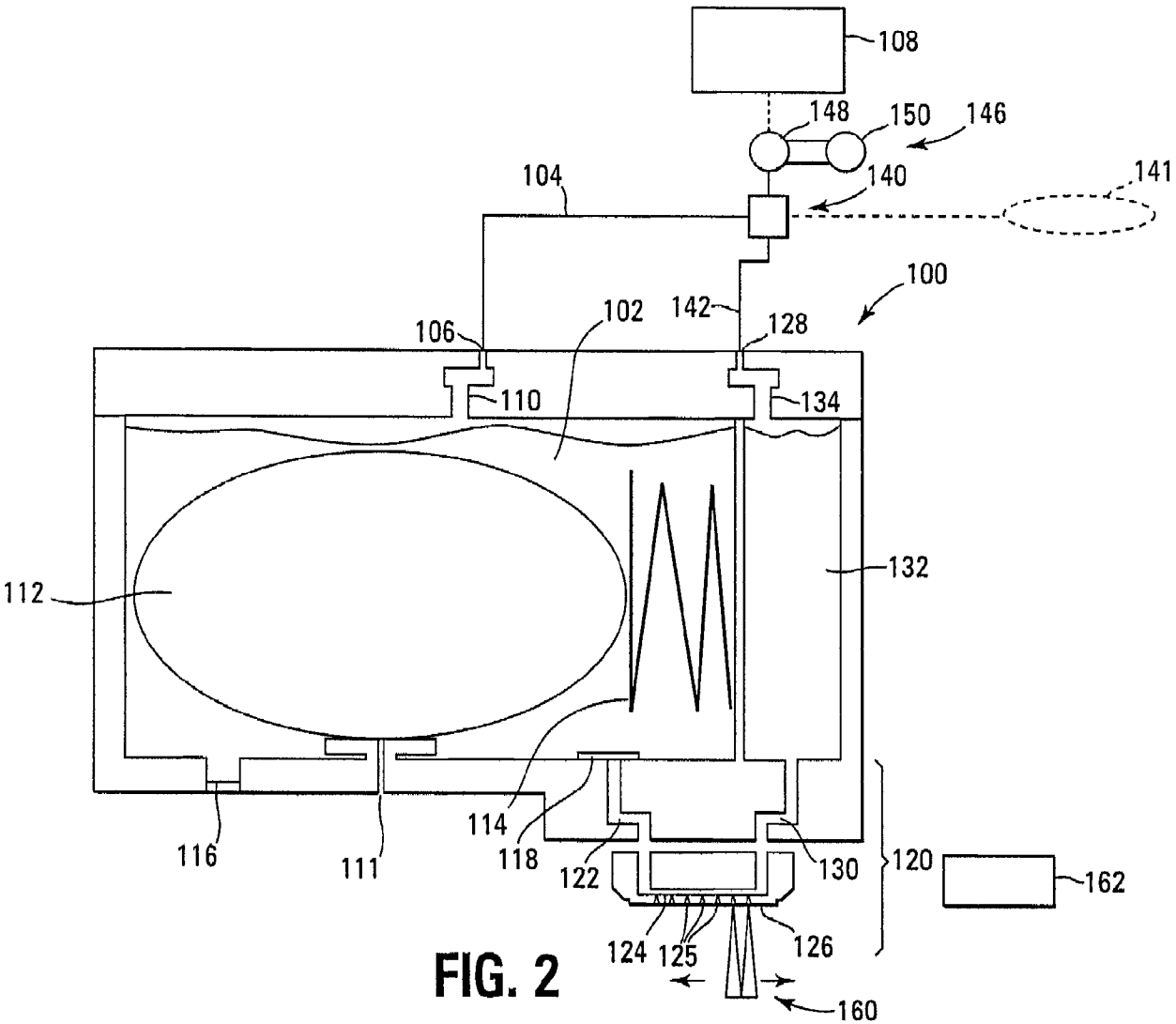
FIG. 2 is a schematic cross section view of a print cartridge that has associated therewith an ink supply system and a vent according to an embodiment of the present invention.

FIG. 2 illustrates a close-up cross-sectional view of an exemplary printhead assembly 100 according to the present invention. FIG. 2 shows only the components corresponding to a single reservoir 102 for a single color, though it is understood that printhead assembly 100 may be adapted to include multiple reservoirs, one for each color printable by a printing system. Conduit 104 is connected to printhead inlet port 106 to provide fluid communication between the off-axis ink supply container 108 and the printhead assembly 100. Inlet port 106 may have a valve mechanism (not shown) associated therewith to control the flow of ink from an off-axis ink supply container 108 to the reservoir 102. Ink flows into reservoir 102 through fluid channel 110 from conduit 104.

In one embodiment, reservoir 102 includes an accumulator bag 112 and spring 114 along with a bubbler 116 to maintain a slight negative pressure in the reservoir 102, as is known in the art. Where ink and/or air is withdrawn from the reservoir 102 through port 106, the accumulator bag 112 expands by drawing air through port 111. Spring 114 and bubbler 116 cooperate to ensure that as ink and/or air is withdrawn from reservoir 102, the accumulator bag 112 does not over inflate. Spring 114 resists pressure from the accumulator bag 112 as it inflates. Bubbler 116 includes a diaphragm or valve element that allows air to enter the reservoir 102 from the exterior, thereby limiting the reduction of pressure within the reservoir 102 to a predetermined level.

A particle filter 118 separates the reservoir 102 from the lower body portion 120 of the print head assembly 100. As needed, ink may flow through particle filter 118 into inlet channel 122 and ultimately into plenum or standpipe 124, which resides directly above a slot (not shown). The slot ultimately feeds a thermal printing device (not shown), which ejects ink through nozzles 125 disposed in the bottom side 126 of the lower body portion 120 of the printhead assembly 100, according to methods known in the art. The standpipe 124 is also fluidically connected to a port 128 via a flow path, which is shown in FIG. 2 as having a channel 130, a conduit 132 and an outlet 134. Channel 130, conduit 132 and outlet 134 may all be generically and collectively referred to herein as a snorkel.

Figure 3:
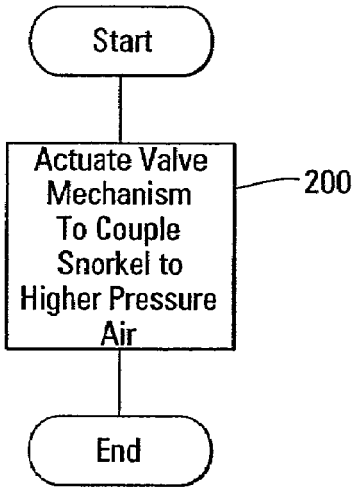
FIG. 3 is a flow chart illustrating exemplary steps in a de-priming process according to one embodiment.
Figure 4:
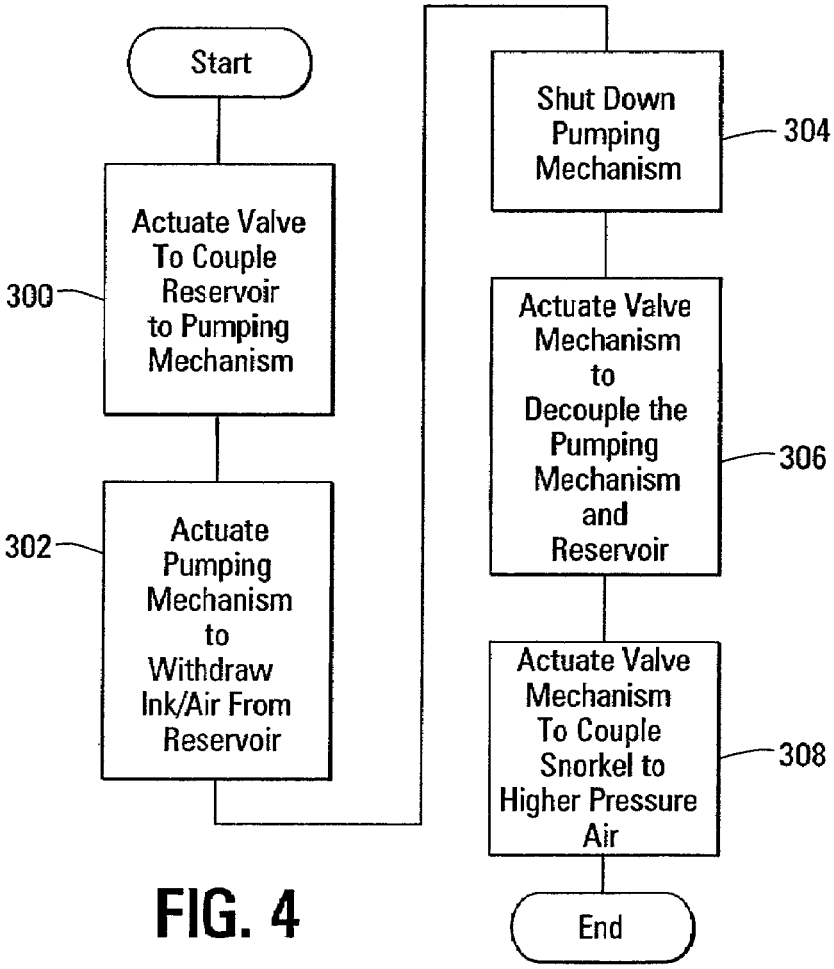
FIG. 4 is a flow chart illustrating exemplary steps in a de-priming process according to another embodiment; and, FIG. 5 is a flow chart illustrating exemplary steps in a priming process used to prepare a de-primed print cartridge for printing according to an embodiment of the present invention.

In one embodiment, ports 106 and 128 are fluidically connected to valve mechanism 140 by conduits 104 and 142, respectively. Note that in other embodiments, ports 106 and 128 may be connected to separate valve mechanisms or the like. Valve mechanism 140 is adapted to selectively couple the off-axis ink supply container 108 to the reservoir 102. In addition, the valve mechanism 140 may couple the snorkel to the atmosphere or to a supply of relatively high pressure air 141. In another embodiment, valve mechanism 140 may include multiple valves connected to one another to effect the various connections described herein in a manner known to those skilled in the art. Coupled between the valve mechanism 140 and the off-axis ink supply container 108 is a pumping mechanism 146 that includes a pump 148 that is powered by motor 150. In another embodiment, pumping mechanism 146 may be omitted in favor of a gravity flow or vacuum operated system. The printhead assembly 100 may optionally be provided with a wiper 160 and wick 162 that function as described in conjunction with FIG. 1.

Where there exists a vacuum within the reservoir 102, inlet channel 122, and standpipe 124, or where there exists a source of pressure higher than that within the reservoir 102, inlet channel 122, and standpipe 124, de-priming the printhead assembly 100 involves actuating valve mechanism 140 to couple the snorkel to atmospheric air or to a supply of air at a pressure greater than that present in the reservoir 102, inlet channel 122 and standpipe 124. This is shown in FIG. 3 at 200. The relatively higher pressure introduced into the snorkel through port 128 forces ink within the snorkel, standpipe 124, and inlet channel 122 back into the reservoir 102 through particle filter 118. When air contacts the particle filter 118, the surface tension of ink in the particle filter 118 is sufficient to substantially prevent the flow of air therethrough and is further able to substantially prevent the flow of ink from the reservoir 102 back into the inlet channel 122.

Where the pressure within the reservoir 102 and the lower body portion 120 is higher than or substantially the same as atmospheric pressure, the process of de-priming the printhead assembly 100 involves a first step of actuating the valve mechanism 140 to couple the reservoir 102 to the pumping mechanism 146 as shown at 300 in FIG. 4. Pumping mechanism 146 is then actuated to withdrawn ink and/or air from the reservoir 102, thereby creating a relatively low pressure or vacuum within the reservoir 102 as at 302. Once there is a relatively low pressure within the reservoir 102, pumping mechanism 146 is shut down (304) and the valve mechanism 140 is actuated to break the connection between the reservoir 102 and the pumping mechanism (306). Finally, valve mechanism 140 is actuated to couple the snorkel to atmospheric air or to a supply of air at a pressure greater than that present in the reservoir 102, inlet channel 122 and standpipe 124 (308).

Once ink has been removed from the region or volume adjacent the nozzles 125 of the printhead 100, wiper 160 is drawn across the nozzles 125 of the printhead assembly 100 to remove external accretions and to apply a non-volatile material obtained from the wick 162 to the orifice plate in which the nozzles 125 of the printhead assembly 100 are formed, thereby preventing the formation of accretions within the nozzles 125.

Figure 5:
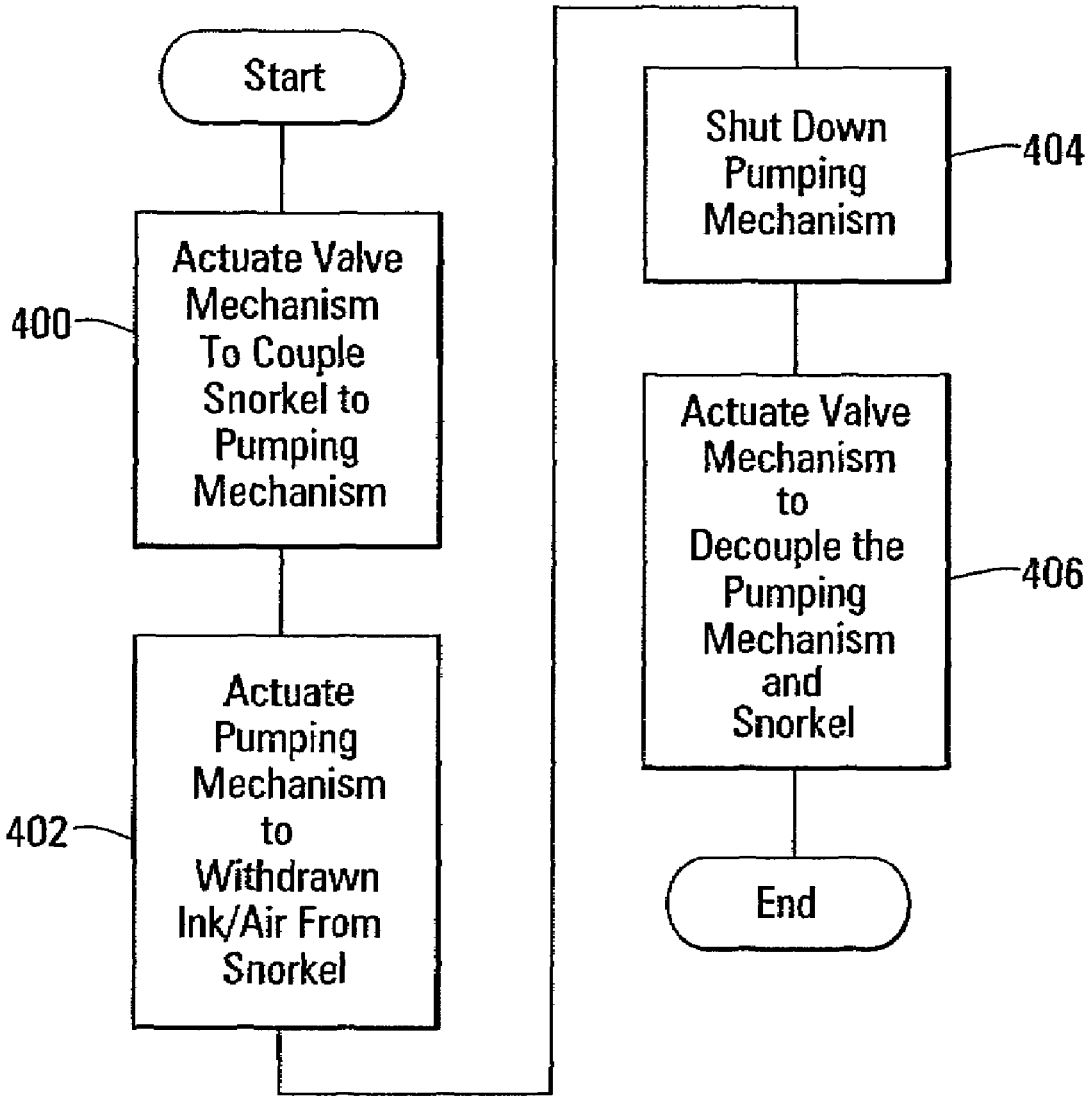

An exemplary embodiment of a method of priming the printhead assembly 100 in preparation for printing is described with reference to FIG. 5. In this embodiment, port 128 of the printhead assembly 100 is coupled to the pumping mechanism 146 by selectively actuating the valve mechanism 140 as at step 400. Thereafter, pumping mechanism 146 is actuated to draw air, and if any remains, ink, from the snorkel (step 402). The withdrawal of air/ink from the snorkel reduces the pressure therein, which subsequently induces ink to flow from the reservoir 102 through particle filter 118 into inlet channel 122 and standpipe 124. Once a sufficient pressure differential has been created as between the reservoir 102 and the lower body portion 120, the pumping mechanism 146 is shut down (step 404) and the valve mechanism 140 is actuated to de-couple port 128 from the pumping mechanism 146 (step 406). Note that valve mechanism 140, upon de-coupling port 128 from the pumping mechanism 146, also seals port 128 and prevents the ingress or escape of air. An alternate embodiment of the method illustrated in FIG. 5 involves coupling the off-axis reservoir 108 to the reservoir 102 through pumping mechanisms 146 and actuating pumping mechanism 146 to pump ink into the reservoir 102 at a pressure sufficient to force ink into the inlet channel 122 and standpipe 124.

CONCLUSION

Although specific embodiments have been illustrated and described herein, it is manifestly intended that this invention be limited only by the following claims and equivalents thereof.

What is claimed is:

1. An ink supply, comprising:

a reservoir for holding ink;

a printhead having a plurality of nozzles therein for ejecting ink;

a standpipe connecting the reservoir and the printhead such that ink may flow from the reservoir to the printhead through the standpipe, the standpipe having a first part adjacent a first end of the printhead through which ink enters the standpipe from the reservoir and a second part adjacent a second end of the printhead;

a snorkel operatively connected to the second part of the standpipe; and a valve operatively connected to the snorkel, the valve operative between a first position in which the first and second parts of the standpipe are pressurized with air introduced into the snorkel from the valve and through the snorkel to the second part of the standpipe to force ink within the standpipe back into the reservoir, and a second position in which the first and second parts of the standpipe are not pressurized with air.

2. The ink supply of claim 1, further comprising a filter interposed between the reservoir and the first part of the standpipe, the filter configured to substantially prevent the flow of air from the standpipe into the reservoir.

3. The ink supply of claim 1, wherein the standpipe is pressurized with air through the second part of the standpipe and ink within the standpipe is forced back into the reservoir through the first part of the standpipe when the valve is in the first position.

4. The ink supply of claim 1, wherein ink within the snorkel and the standpipe is forced back into the reservoir when the valve is in the first position.

5. The ink supply of claim 1, wherein ink within the snorkel and the standpipe is forced back into the reservoir through the first part of the standpipe when the valve is in the first position.

6. The ink supply of claim 1, wherein the valve is further connected to a source of pressurized air, and pressurized air is introduced into the snorkel from the valve and through the snorkel to the second part of the standpipe to force ink within the standpipe back into the reservoir when the valve is in the first position.

7. A print cartridge, comprising:

a reservoir for holding ink;

a printhead having nozzles for ejecting ink;

a standpipe fluidically coupling the reservoir and the printhead;

a snorkel having a first end and a second end, the first end communicating with the standpipe;

a valve communicating with the second end of the snorkel and operative to selectively pressurize the standpipe with air introduced into the snorkel through the second end and through the first end to the standpipe to force ink within the standpipe back into the reservoir; and a filter between the reservoir and the standpipe, the filter configured to allow the flow of ink back and forth between the reservoir and the standpipe but substantially prevent air in the standpipe from passing into the reservoir.

8. The print cartridge of claim 7, wherein the valve is operative to selectively couple the standpipe to atmospheric pressure.

9. The print cartridge of claim 7, wherein the valve is operative to force ink within the snorkel and the standpipe back into the reservoir.

10. The print cartridge of claim 7, wherein the valve is operative to selectively couple the standpipe to a source of pressurized air.

11. A printhead assembly, comprising:

an ink reservoir;

a printhead;

a standpipe communicating with the ink reservoir and the printhead;

a snorkel communicating with the standpipe; and a valve communicating with the snorkel and a source of air pressure, the valve operable between a closed position in which the snorkel and the standpipe are not pressurized with air from the source and an open position in which the snorkel and the standpipe are pressurized with air from the source, wherein ink within the standpipe is forced back into the ink reservoir by the air pressure when the valve is in the open position.

12. The apparatus of claim 11, wherein the source of air pressure comprises atmospheric pressure, the valve operable between the closed position in which the standpipe is not exposed to atmospheric pressure and the open position in which the standpipe is exposed to atmospheric pressure.

13. The apparatus of claim 11, further comprising a port communicating between the snorkel and the valve, the air pressure introduced into the snorkel through the port when the valve is in the open position.

14. The apparatus of claim 11, wherein the standpipe has a first part adjacent a first end of the printhead through which ink enters the standpipe from the ink reservoir and a second part adjacent a second end of the printhead.

15. The apparatus of claim 11, wherein the snorkel is operatively connected to the second part of the standpipe and the source of air pressure.

16. The apparatus of claim 15, wherein ink within the snorkel and the standpipe is forced back into the ink reservoir when the valve is in the open position.

17. The apparatus of claim 11, further comprising a filter between the ink reservoir and the standpipe, the filter configured to allow the flow of ink back and forth between the ink reservoir and the standpipe but substantially prevent air in the standpipe from passing into the ink reservoir.

* * * * *

UNITED STATES PATENT AND TRADEMARK OFFICE

CERTIFICATE OF CORRECTION

PATENT NO. : 7,628,475 B2
APPLICATION NO. : 11/927097
DATED : December 8, 2009
INVENTOR(S) : Jeffrey D. Langford et al.

It is certified that error appears in the above-identified patent and that said Letters Patent is hereby corrected as shown below:

In column 8, line 11, in Claim 15, delete "claim 11," insert -- claim 14, --, therefor.

Signed and Sealed this

Twenty-third Day of March, 2010

David J. Kappos

David J. Kappos
*Director of the United States Patent and Trademark Office*